United States Patent [19]

Wendt

[11] Patent Number: 4,587,774

[45] Date of Patent: May 13, 1986

[54] SYSTEM ADAPTED TO SUPPORT A CANTILEVERED LOAD AT A PARTITION BREAK

[75] Inventor: Alan C. Wendt, Barrington, Ill.

[73] Assignee: United States Gypsum Company, Chicago, Ill.

[21] Appl. No.: 773,780

[22] Filed: Sep. 9, 1985

Related U.S. Application Data

[63] Continuation-in-part of Ser. No. 551,424, Nov. 14, 1983, Pat. No. 4,570,390.

[51] Int. Cl.[4] ..... E04B 2/00

[52] U.S. Cl. ..... 52/36; 52/282; 52/729; 248/243; 211/90; 211/190

[58] Field of Search ..... 52/36, 729, 282; 248/235, 224.4, 243; 211/90, 190, 207

[56] References Cited

U.S. PATENT DOCUMENTS

| | | | |
|---|---|---|---|
| 3,203,151 | 8/1965 | Bransford, Jr. | 52/729 |
| 3,394,507 | 7/1968 | Doke | 52/36 |
| 3,407,547 | 10/1968 | Doke et al. | 52/729 |
| 3,566,361 | 3/1971 | Tozer | 52/729 |
| 3,648,419 | 3/1972 | Marks | 52/36 |
| 3,730,477 | 5/1973 | Wavrunek | 52/36 |
| 3,778,939 | 12/1973 | Nelsson | 52/36 |
| 3,782,048 | 1/1974 | Corman | 52/282 |
| 3,810,340 | 5/1974 | Nelsson | 52/729 |
| 3,828,495 | 8/1974 | Law | 52/36 |
| 4,151,691 | 5/1979 | Wendt | 52/242 |
| 4,231,197 | 11/1980 | Caplan et al. | 52/36 |
| 4,356,672 | 11/1982 | Beckman et al. | 52/36 |
| 4,441,300 | 4/1984 | Varon et al. | 52/732 |
| 4,443,979 | 4/1984 | Varon et al. | 52/36 |
| 4,570,390 | 2/1986 | Wendt | 52/36 |

OTHER PUBLICATIONS

Sweet's Catalog 1979, Sec. 9.1/ce, pp. 1–3, 8.

*Primary Examiner*—John E. Murtagh
*Assistant Examiner*—Caroline Dennison
*Attorney, Agent, or Firm*—Robert M. Didrick; Samuel Kurlandsky; Robert H. Robinson

[57] ABSTRACT

Hollow wall partitions comprising kerfed-edge wallboards supported by kerf-engaging studs often have doors or windows or other breaks adjacent to such a stud which also has the function of supporting a cantilevered load such as a cabinet. Such studs have a bifurcated web comprising a plate portion and a channel housing. The channel housing is open to the frontal insertion of a slotted standard from which the cabinet is suspended.

A multi-functional E-shaped rail is used to connect the windows and doors to the bifurcated stud and to attach the bifurcated stud to a solid wall where the partition begins or ends.

13 Claims, 5 Drawing Figures

SYSTEM ADAPTED TO SUPPORT A CANTILEVERED LOAD AT A PARTITION BREAK

This application is a continuation-in-part of my co-pending application Ser. No. 551,424, now U.S. Pat. No. 4,570,390, was filed on Nov. 14, 1983.

Said co-pending application was directed to a drywall construction system comprising kerfed-edge wallboards and studs having kerf-engaging flanges and a two-tiered channel within a bifurcated web which is open to the frontal insertion and attachment of a slotted standard from which furniture and the like may be suspended. This application is directed to a construction system whereby such heavy loads may be so supported by studs located adjacent to a door or window in the partition or to some other break in the partition such as a solid wall where the drywall partition begins or ends.

Conventional drywall construction systems provide for the mounting of shelves and heavy articles such as furniture on wallboard partitions by means of brackets inserted into slotted standards fastened to studs in the partitions. It is desirable that such systems be strong, adjustable, inexpensive, simple to install, and inconspicuous when not being employed to support such articles.

Attempts have been made in the past to provide mounting systems having one or more of such desirable attributes. In U.S. Pat. No. 3,394,507, Doke teaches a stud having laterally opposed flanges flanking a channel. A slotted standard is attached to the flanges so that the slots open into the channel. Wallboard is fastened to the flanges with screws. Thus, a standard must be placed within a stud at every location where a shelf may be desirable in the future before the wallboard is placed into position. Failing that, the partition would have to be dismantled to insert the standards whenever relocation of shelves is desired. Also, the slots of adjacent standards must be carefully aligned before the standards are fastened so that the shelves or other objects will be level when mounted.

Nelsson teaches an integral stud and standard in U.S. Pat. Nos. 3,778,939 and 3,810,340. Such studs must be carefully measured and installed in order to align the slots of adjacent studs.

Because of its shape, the shelf-bearing, kerf-engaging stud of my co-pending application cannot lie flat against a door frame or concrete wall or the like and thus cannot be securely attached directly to such flat surfaces. But office designers frequently wish to place hang-on furniture modules and shelves adjacent to breaks in the continuity of a wallboard partition such as a free end thereof as well as those breaks mentioned above. For the purposes of this specification and the claims appended thereto, a shelf-bearing stud that is said to be adjacent to a partition break is one that is the penultimate or next to last structural element of the partition before the break. Decorative trim is not a structural element.

It is an object of this invention to provide a system for the construction of drywall partitions on which shelves and heavy objects may be mounted.

It is another object of this invention to provide a system for mounting heavy objects on drywall partitions which is inexpensive, simple to install, and inconspicuous when not being so employed.

It is another object of this invention to provide a stud for drywall construction which allows virtually unlimited adjustment of a slotted standard up and down the length of the stud after the wallboard has been affixed to the stud.

It is another object of this invention to provide a system for supporting a cantilevered load next to a window, a door, or other break in a partition.

It is a related object of this invention to provide such a system wherein a multifunctional, vertical rail may be used as a connector between the shelf-bearing stud and the window pane, door frame, a solid wall, or a terminal trim piece.

It is still further object of this invention to provide a system for mounting heavy objects on drywall partitions which does not require the drilling of holes in the stud components of the partition to accommodate fasteners for the slotted standards.

These and other objects which will be apparent from the drawings and the following description are achieved by the partition system of this invention which utilizes, in combination:

a stud having a web which comprises a plate portion and a channel portion, the walls of the channel having confronting threaded or threadable facets so that the channel may accept a screw at any level, and a pair of opposed flanges extending laterally from said web, and a generally E-shaped rail in longitudinal alignment with the stud, said rail having a first web, a second web, a U-shaped yoke connecting the webs, a unilateral flange extending from each web distal to the yoke, and a terminal return extending toward the yoke from each flange;

said yoke being fastened to the plate of the stud.

The flanges and the channel of the stud, hereinafter called the shelf stud, are symmetrical about the centerline of the plate portion of the web. A pair of flanges in this context means one or more pairs of flanges. The screw may be any threaded fastener such as a wood screw, machine screw, bolt, self-tapping sheet metal screw, or the like. Thus, the threaded facets may be tapered to conform to a wood screw or they may be parallel.

The shelf studs may be interspersed in the interconnecting framework of the studs and runners commonly used in a partition but in this invention their particular use is in combination with the generally E-shaped rail at partition breaks as mentioned above.

A pair of the shelf studs, often but not necessarily consecutively placed, are required for the proper support of long shelves which rest on brackets projecting out from the wall. The use of one such stud is contemplated, however, where the load is concentrated along the centerline of a projecting bracket such as a coat rack or the fulcrum of a child's tetter-totter in a day care center.

The partition system of this invention comprises a framework utilizing a shelf stud and a generally E-shaped rail longitudinally aligned with and fastened to the stud, wallboards fastened to the framework, and the requisite number of slotted or notched standards fastened to the shelf stud, thus adapting the stud to the mounting of brackets by the insertion of bracket hooks into the slots or notches of the standard.

Turning now to the drawings.

Figure 1:
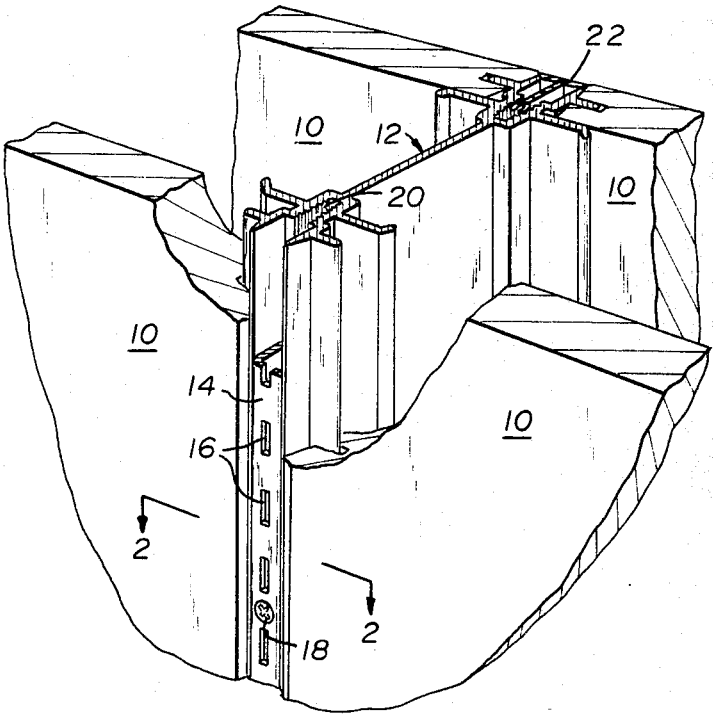
FIG. 1 is a perspective view, partially cut away, of a preferred embodiment of the invention of co-pending application Ser. No. 551,424.

In FIG. 1, the panels 10 are held upright by the extruded aluminum stud 12, and the shelf standard 14, having a column of slots 16, is fastened to the stud 12 by a plurality of screws 18 turned into the threaded channel 20. A filler trim piece 22 is pressed into place where a standard 14 is not required.

Figure 2:
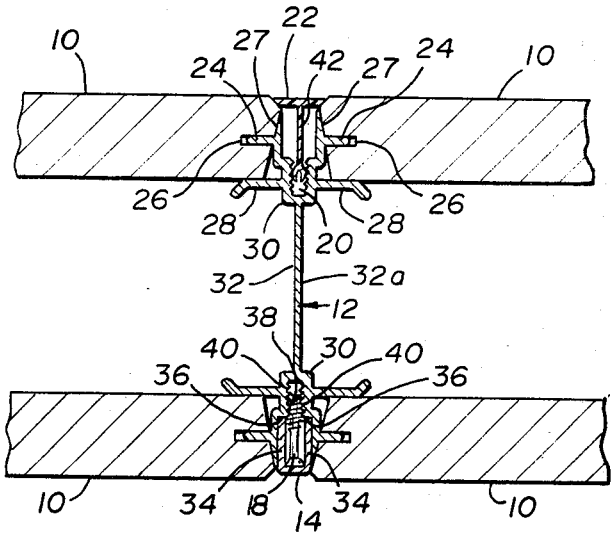
FIG. 2 is a sectional view of the partition system of FIG. 1, taken along line 2—2.

In FIG. 2, the panels 10 are attached to the stud 12 by the insertion of the opposing kerf flanges 24 into the kerfs 26 and the panels 10 are spaced apart by the stops 27 and braced by the opposing buttress flanges 28. The flanges 24 extend laterally from their respective stops 27 and the flanges 28 likewise extend laterally from the channel housings 30 which are U-shaped extensions of the web 32. The web 32 comprises the housing portions 30 and the plate portion 32*a*. The legs 34 of the slotted standard 14 are forced against the ledges 36 of the housings 30 by the engagement of the screw 18 with the threads 38 on the opposing interior walls 40 of the channel housing 30. The trim piece 22, which may be made of a vinyl plastic or other deformable material, is held in place by an anchor leg 42 which fits snugly within the threaded channel 20.

Figure 3:
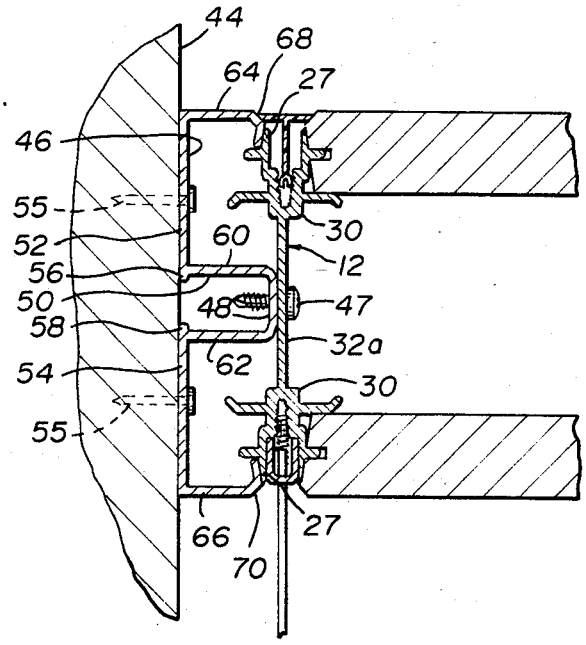
FIG. 3 is a fragmentary sectional view, of a partition system of this invention and of a bracket mounted thereon adjacent to an intersecting solid wall.
Figure 4:
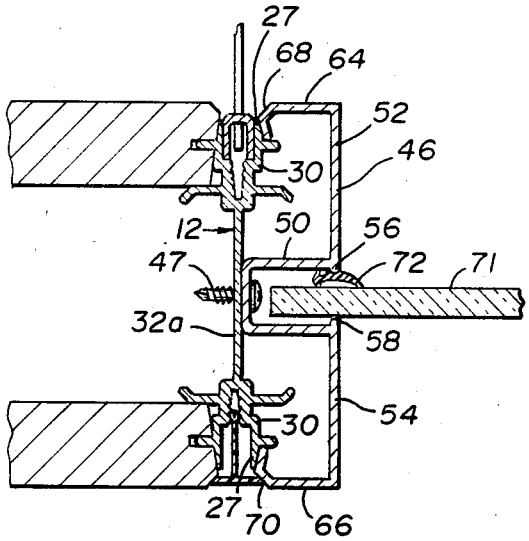
FIG. 4 is a sectional view, of a partition system of this invention showing a shelf stud adjacent to a window.

In FIG. 3, the stud 12 is connected to the solid wall 44 by the generally E-shaped vertical rail 46. The rail is fastened to the stud 12 by the screw 47 which passes through the plate 32*a* and the abutting cross member 48 of the U-shaped yoke 50 while the first and second webs 52 and 54 of the rail are secured to the wall 44 by the fasteners 55. The lips 56 and 58, whose function will be seen in FIG. 4, are extensions of the webs 52 and 54, respectively, beyond the legs 60 and 62 of the yoke 50. Since the hollow wall partition begins at the rail 46 in this construction, the kerf flanges 24 which are adjacent the wall 44 are not connected to wallboard panels and are available as keepers for the rail 46. Extending toward the stud 12 from each of the webs 52 and 54 are the flanges 64 and 66, respectively, and the terminal returns 68 and 70 angle toward the stops 27 and frictionally engage the unoccupied flanges 24 of the stud 12.

In FIGS. 4 and 5, the rail is again fastened to the stud 12 by the screw 47 and the frictional engagement of the terminal returns 68 and 70 with the unoccupied flanges 24 of the stud 12.

In FIG. 4, the rail 46 serves as a glazing rail in which the yoke 50 is a glazing pocket for the window pane 71. The lip 56 holds the glazing gasket 72 which co-operates with the lip 58 to hold the pane upright.

Figure 5:
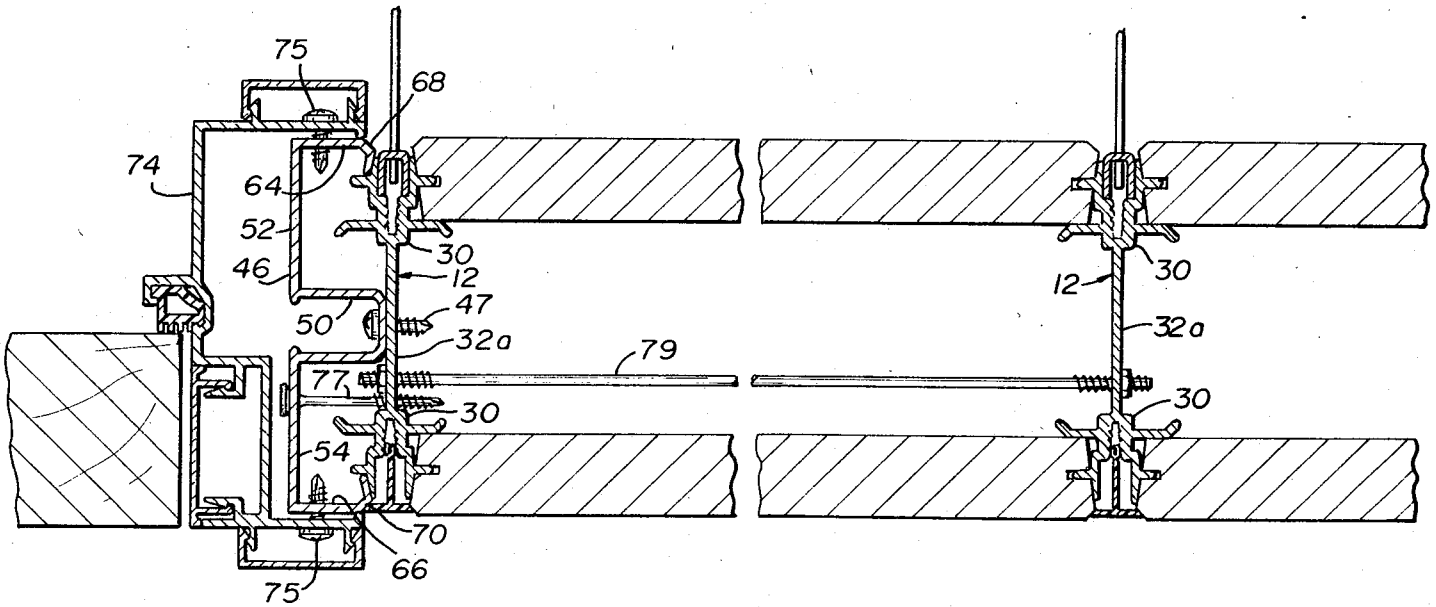
FIG. 5 is a fragmentary sectional view, of a partition system of this invention showing a shelf stud adjacent to a door frame in the partition.

In FIG. 5, the door frame 74 is fastened to the flanges 64 and 66 of the rail 46 with the screws 75. For additional stability, the rail 46 and the stud 12 are connected by the screw 77 which passes through the web 54 of the rail 46 and the plate 32*a*of the stud. Adjacent studs 12 are also tied together by the long machine screw 79.

While several particular embodiments of this invention have been described, it will be understood that the invention may be modified within the spirit and scope of the appended claims.

The subject matter claimed is:

1. A cantilevered load support system for a partition comprising wallboards having kerfed edges, said system comprising:

an upright metal stud comprising a longitudinal web having a central plate portion and a furcated channel housing portion along each longitudinal edge of the plate, a first flange extending laterally from each furcated portion and adapted to extend into a kerfed edge of a wallboard, and a second flange extending from each furcated portion in the laterally opposite direction relative to the first flange;

each furcated portion defining a longitudinal, two-tiered channel, the housing of the first tier being proximate to the plate and having confronting facets adapted to engage the threads of a screw, the second tier being wider than the first and having an unobstructed mouth distal to the plate;

an upright, generally E-shaped rail in longitudinal alignment with the stud, said rail having a first web, a second web, a yoke connecting the webs, a unilateral flange extending from each web, and a terminal return extending toward the yoke from each such flange, so that the second flanges of the stud and the terminal returns are frictionally engaged; and a frontally removable slotted standard within the second tier of a furcated channel of the stud and fastened to the housing of the first tier.

2. The system of claim 1 wherein the yoke is open between the first and second webs and a lip extends from each web into the opening of the yoke.

3. The system of claim 1 wherein the yoke has a pair of side walls and a cross member joining the walls, and wherein said cross member abuts the plate of the stud and is fastened to the plate.

4. The system of claim 1 wherein a first segment of the terminal return of the rail extends away from the web with which it is associated and a second segment of the return extends back toward said web.

5. A wallboard partition which comprises:

an upright metal stud comprising a longitudinal web having a central plate portion and a furcated channel housing portion along each longitudinal edge of the plate, a first flange and a second flange extending laterally from each furcated portion in laterally opposite directions;

each furcated portion defining a longitudinal, two-tiered channel, the housing of the first tier being proximate to the plate and having confronting facets adapted to engage the threads of a screw, the second tier being wider than the first and having an unobstructed mouth distal to the plate;

an upright, generally E-shaped rail in longitudinal alignment with the stud, said rail having a first web, a second web, a yoke connecting the webs, a flange extending from each web, and a terminal return extending toward the yoke from each such flange so that the second flange of the stud and the terminal returns are frictionally engaged; and a wallboard panel having a front side, a back side, and an edge between said sides, said edge having a kerf into which the first stud flange extends.

6. The partition of claim 5 wherein the terminal return abuts the housing of the second tier of the furcated channel housing.

7. The partition of claim 5 wherein a first segment of the terminal return of the rail extends away from the web with which it is associated and a second segment extends back toward said web.

8. The partition of claim 5 wherein the yoke is open between the first and second webs and a lip extends from each web into the opening of the yoke.

9. The partition of claim 5 wherein the yoke has a pair of side walls and a cross member joining the walls, and wherein said cross member abuts the plate of the stud and is fastened to the plate.

10. The partition of claim 5 characterized further by a frontally removable slotted standard within the second tier of the stud channel and fastened to the facets of the first tier.

11. The partition of claim 8 characterized further by a window pane mounted between the lips of the rail and extending into the opening of the yoke.

12. The partition of claim 5 characterized by a door frame mounted on the flanges of the rail.

13. The partition of claim 5 characterized in that the webs of the rail are fastened to a solid wall.

* * * * *